United States Patent [19]

Seilly et al.

[11] 4,197,518

[45] Apr. 8, 1980

[54] ELECTROMAGNETIC ACTUATING DEVICE EMPLOYING LEVER MEANS

[75] Inventors: Alex H. Seilly, N. Wembley; James Campbell, London, both of England

[73] Assignee: Lucas Industries Limited, Birmingham, England

[21] Appl. No.: 851,800

[22] Filed: Nov. 15, 1977

[30] Foreign Application Priority Data

Nov. 19, 1976 [GB] United Kingdom ..... 48267/76

[51] Int. Cl.[2] ..... H01H 50/16

[52] U.S. Cl. ..... 335/126; 251/129; 335/274

[58] Field of Search ..... 335/274, 192, 220, 266, 335/126, 131; 310/23; 251/129

[56] References Cited

U.S. PATENT DOCUMENTS

| | | | |
|---|---|---|---|
| 3,880,476 | 4/1975 | Belart et al. | 335/274 |
| 3,940,726 | 2/1976 | Gershnow | 335/192 |
| 4,037,704 | 7/1977 | Golobay et al. | 335/274 |

*Primary Examiner*—Harold Broome

[57] ABSTRACT

An actuating device comprises an operating member movable by electrically operated means and an output member. Lever means in the form of an apertured disc connects the operating member and the output member. The disc is engaged at or adjacent pits in the periphery with the output member and at a first position outwardly of the inner periphery, by the operating member and at a second position removed from the first position by a reaction member.

15 Claims, 8 Drawing Figures

ELECTROMAGNETIC ACTUATING DEVICE EMPLOYING LEVER MEANS

This invention relates to actuating devices of the kind comprising a housing, an operating member movable within the housing, electrically operated means for effecting movement of said operating member and an output member movable in a linear fashion, said output member being coupled to said operating member so as to undergo linear movement as a result of movement of said operating member.

The object of the invention is to provide such a device in a simple and convenient form.

According to the invention an actuating device of the kind specified comprises lever means in the form of an apertured disc engageable at or adjacent its inner periphery with said output member, the disc being engaged at a first position removed from the inner periphery thereof by said operating member and at a second position removed from said first position by a reaction member, whereby movement of said operating member will effect movement of the output member by an amount depending upon the lever ratio.

According to a further feature of the invention the surfaces of said operating member and reaction member which engage said disc, are of annular form.

According to a further feature of the invention said disc is provided with radial slits which terminate short of the inner or outer periphery of the disc.

Figure 1:
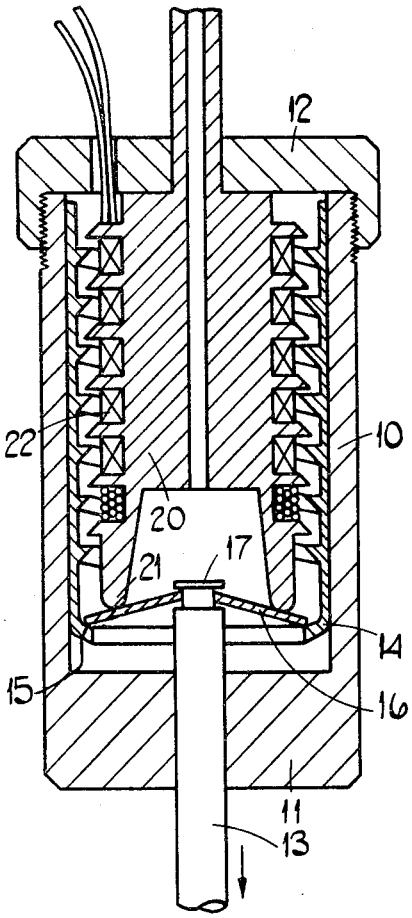
Figure 2:
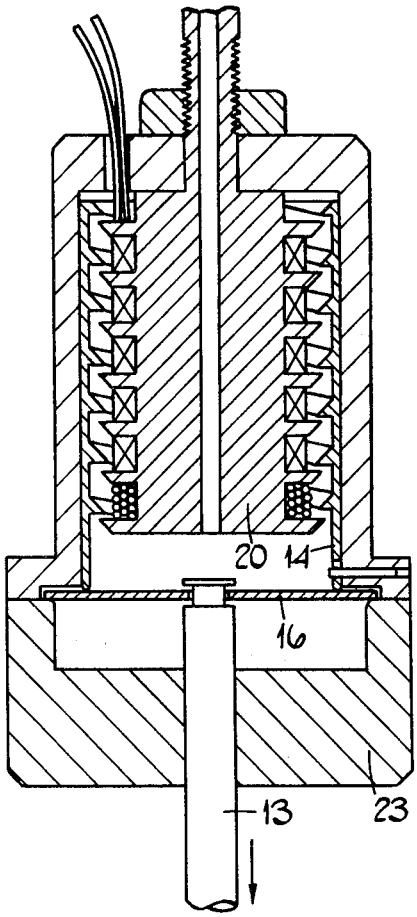
Figure 3:
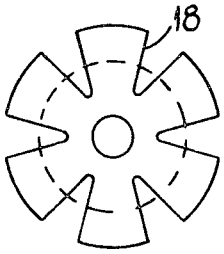
Figure 4:
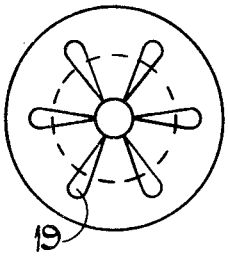
Figure 5:
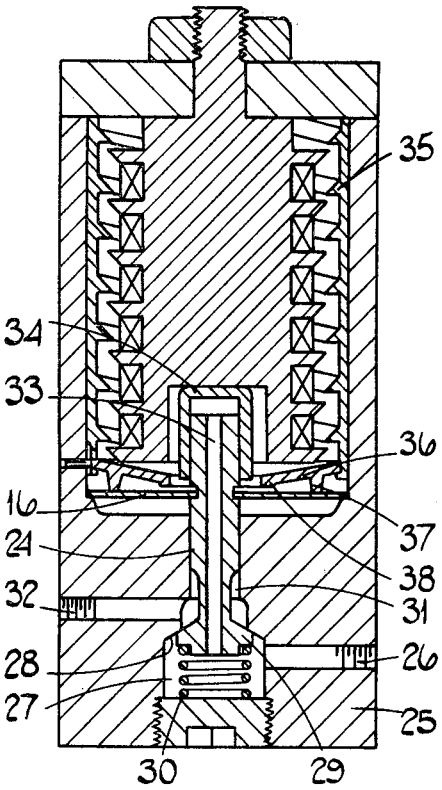
Figure 7:
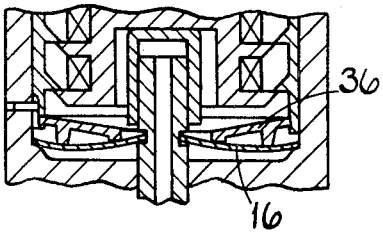
Figure 6:
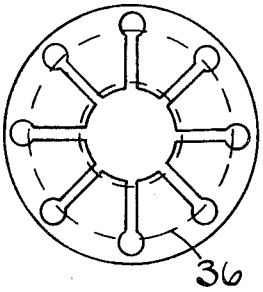
Figure 8:
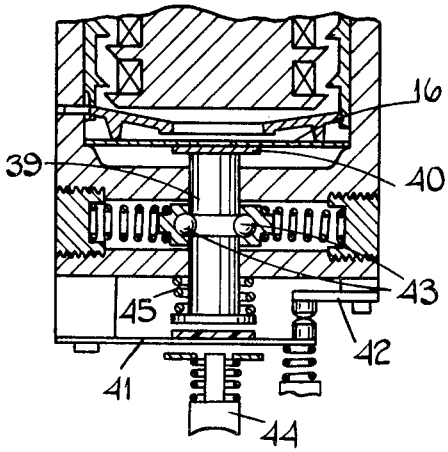

Examples of actuating device in accordance with the invention will now be described with reference to the accompanying drawings in which;

FIGS. 1 and 2 are sectional side elevations of two examples of the device in accordance with the invention, FIGS. 3 and 4 are plan views showing alternative forms of a part of the devices seen in FIGS. 1 and 2, FIG. 5 is a sectional side elevation showing another form of the device and shown coupled to a valve member, FIG. 6 is a plan view of a part of the device shown in FIG. 5, FIG. 7 shows a portion of the device shown in FIG. 5 in an alternative position and FIG. 8 shows an actuating device substantially the same as that which is shown in FIG. 5 but coupled to an electrical switch.

Referring to FIG. 1 of the drawings there is provided a hollow body 10 with an integral end wall 11. The other end of the body is closed by a cap 12 which is in screw thread engagement with the body. The body defines a cylindrical chamber and formed in the end wall 11 is a bore in which is slidable in a linear manner, an output member 13. Mounted within the chamber is an annular operating member 14 this being guided for linear movement by the wall of the chamber. As shown in FIG. 2, means is provided to prevent angular movement of the operating member 14. At its end adjacent the end wall 11 the operating member is turned inwardly to define an annular abutment surface 15. The abutment surface is engaged with the outer periphery of a lever means in the form of a disc 16. The disc 16 is provided with a central aperture and a reduced portion of the output member 13 extends through the aperture and is provided with a head 17. The disc 16 is provided with radial slits and two forms of the disc are shown in FIGS. 3 and 4. In the form of disc shown in FIG. 3 the slits which are referenced 18 extend inwardly from the outer periphery but terminate short of the aperture. Moreover, the slits taper inwardly towards the aperture. In the form of disc shown in FIG. 4 the slits referenced 19 extend outwardly from the aperture and the walls defining the slit diverge outwardly over a substantial portion of the length of the slit.

Mounted on the end cap 12 is a member 20 which defines an annular reaction member 21. The reaction member 21 is smaller in diameter than the portion of the operating member which defines the abutment surface 15. The reaction member engages the disc at a position intermediate the inner and outer peripheries thereof. The disc constitutes a lever means and the arrangement is such that movement of the operating member 14 in an upward direction as shown in FIG. 1 will cause downward movement of the output member 13. As shown in FIG. 1 the lever ratio is such that the output member 13 will partake of a movement in the direction of the arrow larger than the movement of the operating member. The disc is constructed from resilient material and there will be a tendency for the parts to revert to the position shown when the operating member is allowed to move downwardly.

The electrical means which effects movement of the operating member is of an electro-mechanical nature, the operating member being formed from magnetisable material movable by a magnetic field when the winding carried on the member 20 is supplied with electric current. In the particular example the operating member 14 is provided with a two-start helical thread form and the member 20 is provided with a similar thread form which thereby defines two helical grooves. The electrical winding is located within the grooves and as shown comprises a multi-turn winding, the winding being formed by passing a wire down one of the grooves and allowing the wire to return along the other of the grooves, this process being repeated until the desired number of turns are obtained. In this manner when uni-directional current is supplied to the windings the two ribs on the member 20 will be magnetically polarised with opposite polarities. As a result the ribs on the member 14 will be attracted towards the ribs on the member 20.

It will be understood that the electromagnetic device described is but one form of many types of electromagnetic device which could be utilised. Moreover, it will be appreciated that other forms of electrically operable device could be employed such for example as a stack of piezo electric crystals.

The construction of the device shown in FIG. 2 is in many respects similar to that which is shown in FIG. 1. The member 20 defines the helical ribs or thread forms but it does not, as was the case with the example of FIG. 1, define the reaction member. Instead the reaction member is constituted by a step formed on an end closure 23 in which the output member is slidable. Moreover it will be noted that the step engages with the outer periphery of the disc. It will further be observed that the operating member 14 engages the disc 16 at a position between the centre of the disc and the outer periphery of the disc. The practical effect is that the operating member and the output member 13 move in the same direction when the winding is energised. Again as with the example of FIG. 1, the lever ratio is such that the output member will move through a greater distance than the operating member.

Turning now to FIG. 5 the actuating device is substantially the same as that which is shown in FIG. 2 but in this case the output member is formed as a valve element 24 slidable within a body portion 25. The body portion is provided with an inlet 26 for connection to a source of fluid pressure and this leads into a chamber 27 which defines a seating 28 for engagement by a head 29 defined on the valve member. The valve member is spring loaded by means of a coiled compression spring 30 into contact with the seating and below the head, is of reduced diameter so as to define an annular chamber 31 which is in communication with an outlet passage 32. Moreover, formed in the valve member is a central passage 33 which places the inlet passage 26 in communication with the end of the valve member remote from the spring. At this end the valve member is slidable within a cup shaped member 34 which defines a closed cylinder so that the pressure in the inlet acts upon the opposite ends of the valve member. As a result when the valve member is open it is substantially pressure balanced. When the valve member is closed it is urged by the spring and fluid pressure to the closed position, the valve member not being balanced in the closed position because the area defined by the seating is larger than the area of the remote end of the valve member.

The disc 16 is arranged exactly as shown in FIG. 2 but in the example of FIG. 5 the operating member which is referenced 35, does not operate directly upon the disc. Instead the operating member is coupled to an annular ridged member 36 which defines an outer annular projection 37 engaging with the disc at a position spaced inwardly from the outer periphery thereof and a second annular projection which can engage with the disc at a position nearer to the inner periphery of the disc. In FIG. 6 there is shown in dotted outline the relative spacings of the projections 37, 38.

In operation, when the winding is energised the operating member 35 will move downwardly and the annular projection 37 will also move downwardly causing deflection of the disc 16. The disc 16 being formed from resilient material stores the energy attained by the operating member during this movement. This disc 16 will bow downwardly and after a predetermined distortion of the disc has taken place, the projection 38 will engage the disc and the magnetic force which is exerted on the operating member, will then be applied to the valve member together with a proportion of the energy gained by the operating member during its movement. This force is sufficient to lift the valve member from its seating and the valve member will accelerate to the fully open position. It should be noted that the extent of movement of the valve member will be greater than the movement of the operating member by an amount which does depend upon the lever ratio of the disc. The situation which exists when the projection 37 contacts the disc is shown in FIG. 7.

In the arrangement which is shown in FIG. 8 the operating member 39 is provided with a head 40 which engages with the disc 16, the latter still being provided with a central aperture. The operating member 39 has a head at its opposite end which can engage with a contact blade 41 which mounts a contact normally engaging a further contact on a fixed blade 42. A spring is provided to maintain the contacts in engagement with each other. Moreover, the operating member 39 is maintained in an inoperative position by a pair of spring loaded balls 43 which engage within a groove formed in the operating member.

A manual reset button 44 is provided to move the parts to the position shown and during such movement the output member 39 is moved against the action of a spring 45.

When the operating member is moved by energising the winding, the process described with reference to FIG. 5 takes place and at some point the restraint imposed by the balls 43 is overcome and the output member 39 moves to a position in which the contacts are separated. Such movement is very rapid and the strength of the spring 45 is such that even when the flow of electric current in the windings ceases, the contacts will still be held in the open position.

If the reset button 44 is depressed then the force exerted by the spring 45 is overcome and the balls 43 are urged into the groove to hold the output member 39 in the position shown. As with the example of FIG. 5 the movement of the output member 39 is greater than that of the operating member.

We claim:

1. An actuating device comprising a housing, an operating member movable within the housing, electrically operated means for effecting movement of said operating member, an output member, lever means coupling said output and operating members, said lever means comprising an apertured disc engageable at or adjacent its inner periphery with said output member, said operating member engaging said disc at a first position removed from the inner periphery and a reaction member engaging said disc at a second position removed from said first position, whereby movement of said operating member will effect movement of the output member by an amount depending on the lever ratio.

2. An actuating device as claimed in claim 1 in which the surfaces of said operating member and said reaction member which engage the disc are of annular form.

3. An actuating device according to claim 2 in which said disc is provided with radial slits which terminate short of one of the inner or outer peripheral surfaces of the disc.

4. An actuating device comprising a housing, an operating member movable within the housing, electrically operated means for effecting movement of said operating member, an output member, lever means coupling said output and operating members, said lever means comprising an apertured disc engageable at or adjacent its inner periphery with said output member, said disc being provided with radial slits which terminate short of one of the inner or outer peripheral surfaces of the disc, said operating member engaging said disc at a first position removed from the inner periphery, and a reaction member engaging said disc at a second position removed from said first position, the surfaces of said operating member and said reaction member which engage the disc being of annular form, said operating member defining a further annular surface engageable with the disc after predetermined movement of the operating member, said predetermined movement causing flexure of the disc, whereby movement of said operating member will effect movement of the output member by an amount depending on the lever ratio.

5. An actuating device according to claim 3 in which said electrically operated means comprises an electromagnetic device, said operating member forming the armature of said electromagnetic device.

6. An actuating device according to claim 4 in which said electrically operated means comprises an electromagnetic device including an armature, said operating members being carried by said armature.

7. An actuating device according to claim 6 in which said armature is of annular form and is guided for movement within the housing, said operating member being mounted at one end of said armature and extending inwardly thereof.

8. An actuating device according to claim 7 including means restraining the movement of the output member, the force exerted by said means being overcome by the magnetic force exerted on the armature and the energy stored in the disc after said predetermined movement.

9. An actuating device according to claim 8 in which the means restraining movement comprises a spring loaded catch.

10. An actuating device as claimed in claim 9 in which said catch comprises a ball engageable within a groove formed in the output member.

11. An actuating device as claimed in claim 10 including a pair of electrical contacts, resilient means acting to maintain said contacts in the closed position, one of said contacts being engageable by said output member when said catch is released, thereby to open said contacts.

12. An actuating device as claimed in claim 11 including a further resilient means acting on said output member and operable to maintain said contacts in the open position.

13. An actuating device as claimed in claim 12 including manually operably means for moving said one contact and the output member against the action of said further resilient means.

14. An actuating device according to claim 9 in which said output member is in the form of a valve member operable to control fluid flow through a passage, said means comprising a surface defined by said valve member and against which fluid pressure can act, said valve member being constructed so that when said valve member has been moved by the operating member the fluid forces acting thereon are substantially zero.

15. An actuating device according to claim 14 including resilient means acting on the valve member to oppose the movement of the valve member by said operating member.

* * * * *